US005180315A

United States Patent [19]

Nagashima

[11] Patent Number: 5,180,315

[45] Date of Patent: Jan. 19, 1993

[54] SURFACE-MOUNTED HIGH-FREQUENCY COAXIAL CONNECTOR

[75] Inventor: Masayuki Nagashima, Tokyo, Japan

[73] Assignee: Hirose Electric Co., Ltd., Tokyo, Japan

[21] Appl. No.: 889,354

[22] Filed: May 28, 1992

[30] Foreign Application Priority Data

Jun. 27, 1991 [JP] Japan ..... 3-57079[U]

[51] Int. Cl.[5] ..... H01R 13/00

[52] U.S. Cl. ..... 439/581

[58] Field of Search ..... 439/578-585, 439/63

[56] References Cited

U.S. PATENT DOCUMENTS 3,564,478 2/1971 Hampton ..... 439/581

3,879,103 4/1975 Peltola et al. ..... 439/581

4,603,926 8/1986 Nesbit et al. ..... 439/581

*Primary Examiner*—Joseph H. McGlynn

*Attorney, Agent, or Firm*—Kanesaka & Takeuchi

[57] ABSTRACT

A surface-mounted, high-frequency coaxial connector, which includes a molding (3) having a fitting cavity (5), a central column (6) with an aperture (7), a plurality of openings (9*a*, 9*b*, 9*c*) around the central column; an outer terminal (11) having a plurality of depending contacts (15, 16, 17) and fitted over the central column such that the depending contacts are press fitted into the openings and that projecting contact portions are bent outwardly to provide ground contacts (40); and an inner terminal (12) having a central contact (19) inserted into the aperture and a contact leg set on a rear face of the molding to provide a hot contact (41). The outer terminal is made in the form of a cylinder.

2 Claims, 8 Drawing Sheets

SURFACE-MOUNTED HIGH-FREQUENCY COAXIAL CONNECTOR

BACKGROUND OF THE INVENTION

1. Field of the Invention

The present invention relates to surface-mounted high-frequency coaxial connectors.

2. Description of the Prior Art

In FIGS. 17–19, a conventional surface-mounted h-f coaxial connector receptacle 50 includes a molding 51 and an ground terminal 52 which is integrally formed with the molding 51 as a unit. The molding 51 has a fitting cavity 53 and a central column 54 formed at the center of the fitting cavity 53 such that it has a contact receiving aperture 55. The ground terminal 52 is a arcking metal plate provided on the inside wall of the fitting cavity 53. The ground terminal 52 has a ground contact 57 which extends rearwardly and then upwardly along the rear face and finally forwardly and rests on the top face of the molding 51. A male contact 59 of a male terminal 58 is inserted into the contact receiving aperture 55 from the back of the molding 51. A hot contact 60 of the male terminal 58 is set in a groove 61 on the rear face of the molding 51. Also, a pair of dummy terminals 62 and 63 are provided on opposite sides of the rear face.

When the mating portion of a plug is fitted in the fitting cavity 53 of the receptacle 50, the male terminal 58 and the ground terminal 52 are brought into contact with the female terminal and the shield terminal of the plug.

In the above receptacle 50, however, a metal mold for integrally molding the molding 51 and the ground terminal 52 as a unit is necessary, thus pushing up the manufacturing costs. In addition, the arc-shaped ground terminal 52 frequently suffers poor contacts.

SUMMARY OF THE INVENTION

Accordingly, it is an object of the invention to provide a surface-mounted h-f coaxial connector which does not need any metal mold for integrally forming the molding and the outer terminal, thus reducing the manufacturing costs.

It is another object of the invention to provide a surface-mounted h-f coaxial connector having an outer terminal which has stable contacts with the mating contact.

According to the invention there is provided a surface-mounted, high-frequency coaxial connector, which includes a molding having a fitting cavity, a central column with an aperture, a plurality of openings around the central column; an outer terminal having a plurality of depending contacts and fitted over the central column such that the depending contacts are press fitted into the openings and that projecting contact portions are bent outwardly to provide ground contacts; and an inner terminal having a central contact inserted into the aperture and a contact leg set on a rear face of the molding to provide a hot contact. The outer terminal is made in the form of a cylinder.

With the coaxial connector according to the invention, it is possible to eliminate the metal mold for integrally molding the ground terminal and the molding, thus not only improving the assembling operation but also reducing the manufacturing costs.

The cylindrical ground terminal is able to contact the shielding terminal of a mating connector on the entire circumference, thereby assuring stable contacts.

The above and other objects, features, and advantages of the invention will be more apparent from the following description when taken in conjunction with the accompanying drawings.

DESCRIPTION OF THE PREFERRED EMBODIMENT

Figure 1:
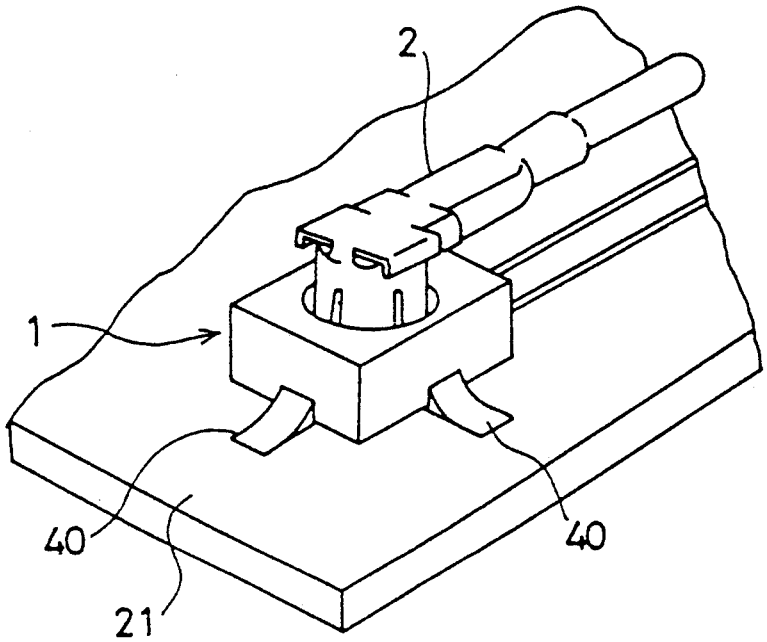
FIG. 1 is a perspective view of a surface-mounted h-f coaxial connector consisting of a connector receptacle and a connector plug according to an embodiment of the invention.

In FIG. 1, a surface-mounted h-f coaxial connector according to an embodiment of the invention consists of a connector receptacle 1 and a connector plug 2. Ground contacts 40 of the connector receptacle 1 are soldered to a substrate 21.

Figure 2:
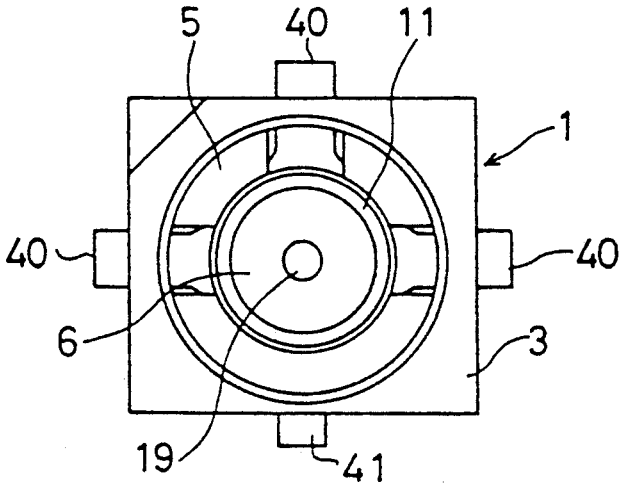
FIG. 2 is a top plan view of the connector receptacle.
Figure 3:
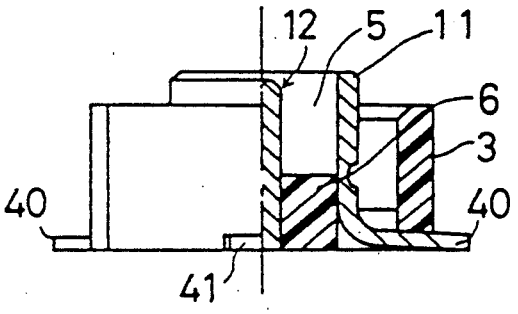
FIG. 3 is a partially cutaway side elevational view thereof.
Figure 4:
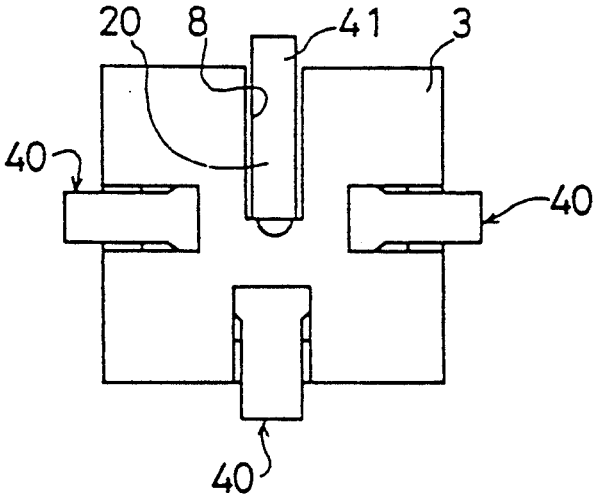
FIG. 4 is a bottom plan view thereof.
Figure 5:
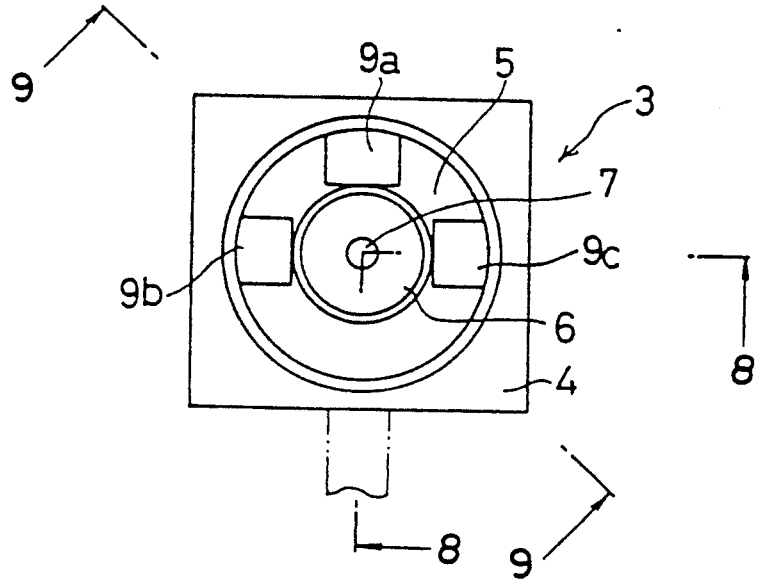
FIG. 5 is a top plan view of a molding of the connector receptacle.
Figure 6:
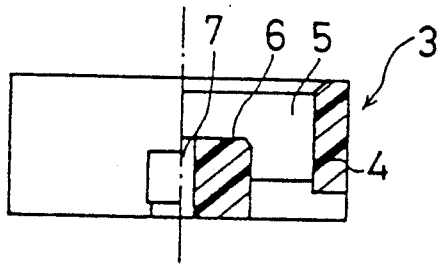
FIG. 6 is a partially cutaway side elevational view thereof.
Figure 7:
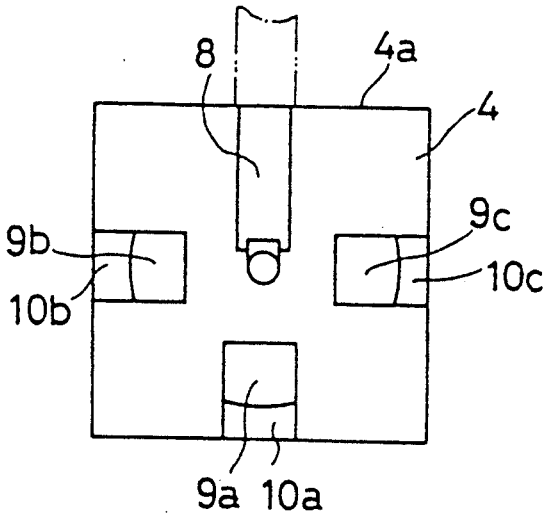
FIG. 7 is a bottom plan view thereof.
Figure 8:
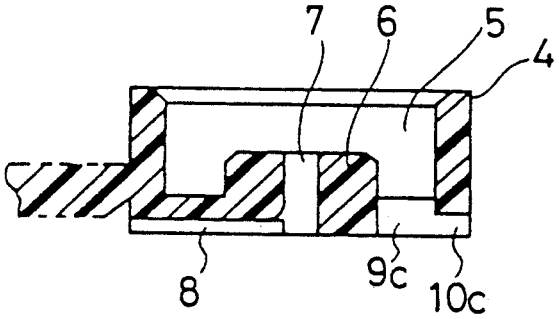
FIG. 8 is a sectional view taken along line 8—8 of FIG. 5.
Figure 9:
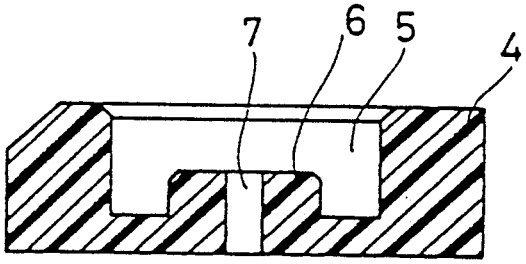
FIG. 9 is a sectional view taken along line 9—9 of FIG. 5.

In FIGS. 2–4, the connector receptacle 1 includes a molding 3 of a dielectric synthetic resin, an outer or ground terminal 11, and an inner or male terminal 12.

In FIGS. 5–9, the molding 3 has a rectangular body 4 with a central circular recess 5. A central column 6 extends upwardly from the bottom of the circular recess 5 and has an aperture 7 therethrough. A groove 8 is formed on the rear face of the rectangular body 4 between the aperture 7 and one side of the rectangular body 4. Three openings **9*a*, 9*b*, and 9*c* are formed on the bottom of the circular recess 5; one at a position opposite to the groove 8 and two on opposite sides of the groove 8. Also, three cutouts 10*a*, 10*b*, and 10*c* are formed on the rear face between the respective openings 9*a*, 9*b*, and 9*c* and the corresponding sides of the rectangular body 4**.

Figure 10:
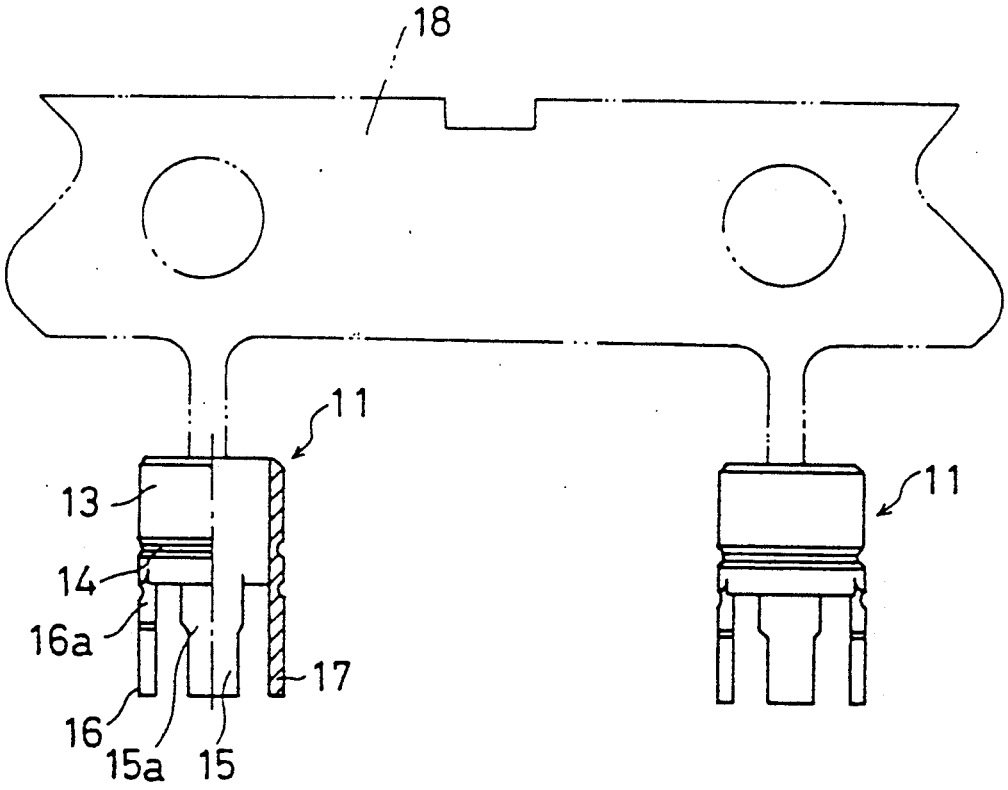
FIG. 10 is a partially cutaway side view of an outer terminal shell of the connector receptacle.
Figure 11:
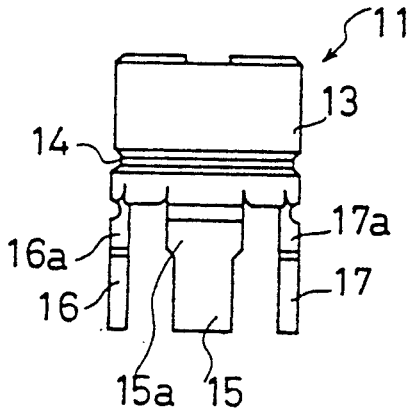
FIG. 11 is a side elevational view thereof.
Figure 12:
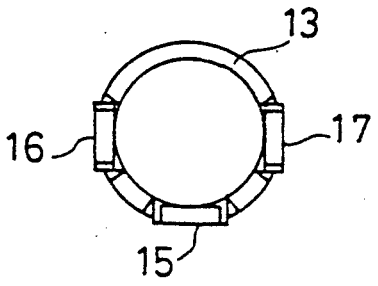
FIG. 12 is a bottom plan view thereof.

In FIGS. 10–12, the outer terminal 11 has a cylindrical metal shell 13 which has a circular engaging groove 14 and three depending contacts 15, 16, and 17. Each depending contact 15, 16, or 17 has a press-fit base 15*a*, 16*a*, or 17*a*. A number of metal shells 13 are attached to a carrier 18.

Figure 13:
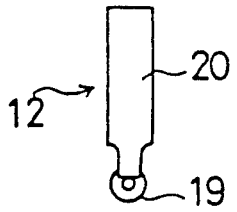
FIG. 13 is a rear elevational view of a male terminal of the connector receptacle.
Figure 14:
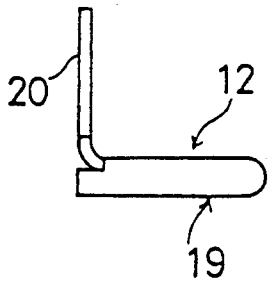
FIG. 14 is a side elevational view thereof.

In FIGS. 13–14, the male terminal 12 has a male contact 19 and a contact leg 20 which is bent at right angles to the male contact 19.

To assemble the connector socket 1, the outer terminal 11 is fitted over the central column 6 of the molding 3 from the top such that the press-fit bases 15*a*, 16*a*, and 17*a* of the depending contacts 15, 16, and 17 are press fitted into the openings 9*a*, 9*b*, and 9*c* of the molding 3. Then, the projected depending contacts 15, 16, and 17 are bent outwardly into the cutouts 10*a*, 10*b*, and 10*c* to form ground contacts 40. The male contact 19 is inserted into the contact receiving aperture 7 of the central column 6 from the back such that the contact leg 20 is set in the groove 8 on the rear face of the molding 3 to form a hot contact 41. Consequently, the male contact 19 is placed at the center of the ground terminal 11.

Figure 15:
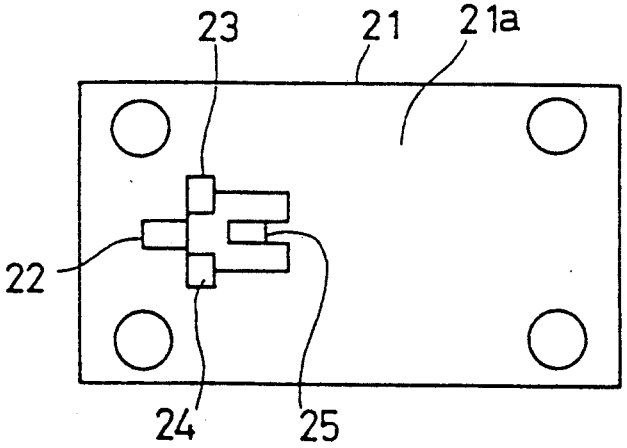
FIG. 15 is a top plan view of a substrate on which the connector receptacle is mounted.
Figure 17:
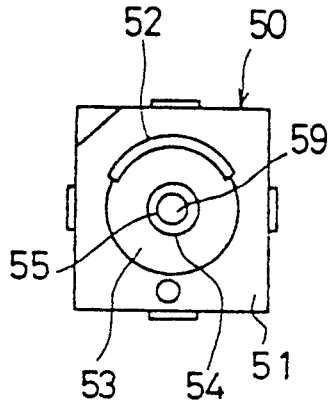
FIG. 17 PRIOR ART
FIG. 17 is a top plan view of a conventional surface-mounted h-f coaxial connector receptacle.
Figure 18:
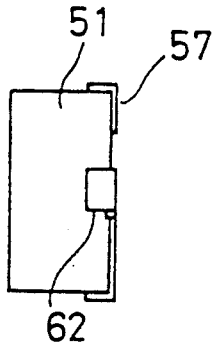
FIG. 18 PRIOR ART
FIG. 18 is a side elevational view thereof.
Figure 19:
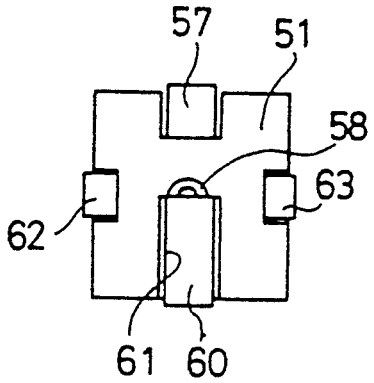
FIG. 19 PRIOR ART
FIG. 19 is a rear elevational view thereof.

In FIG. 15, the ground contacts 40 and the hot contact 41 of the connector receptacle 1 are soldered to the ground conductors 22, 23, and 24 and the hot contact conductor 25, respectively, of a substrate 21.

Figure 16:
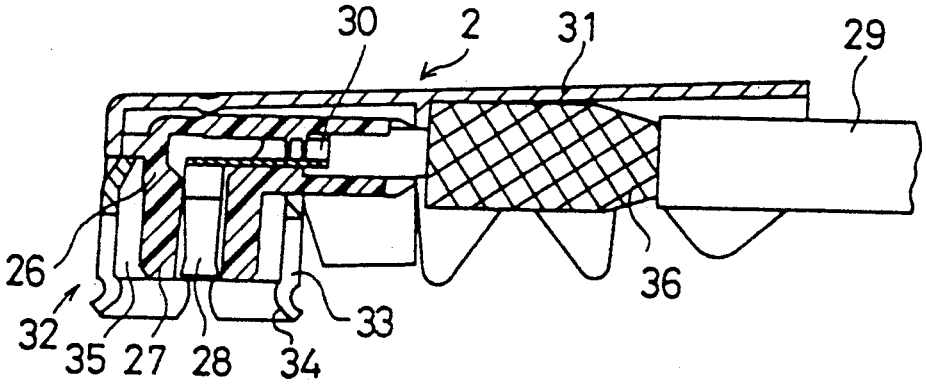
FIG. 16 is a longitudinal section of the connector plug.

In FIG. 16, the connector plug 2 includes an L-shaped insulation housing 26 which has a fitting column 27 on the front end. A female terminal 28 is fitted into the fitting column 27. A central conductor 30 of a coaxial cable 29 is connected to the female terminal 28. A shielding cover 31 surrounding the insulation housing 26 has a cylindrical shell 32 which has a number of vertical slits 33 on the side wall to form a fitting portion 34. The cylindrical shell 32 and the fitting column 27 form an annular space 35. The shielding cover 31 holds the shielding wire 36 of a coaxial cable 29.

For use, the fitting column 27 of the connector plug 2 is fitted into the fitting cavity 5 of the connector receptacle 1 such that the female contact 28 is fitted over the male contact 19 while the ground terminal 11 is fitted into the fitting portion 34 of the connector plug 2 so that the shielding shell 32 is brought into contact with the ground terminal 11 on the entire circumference.

With the connector according to the invention it is possible to eliminate the need for a metal mold for integrally forming a molding and a ground terminal as a unit, thereby reducing the manufacturing cost.

The outer terminal 11 is made cylindrical so that it can be brought into contact with the shielding shell 32 of a connector plug 2 on the entire circumference, thereby assuring stable contacts.

I claim:

1. A surface-mounted, high-frequency coaxial connector, comprising:

a molding having a fitting cavity, a central column with an aperture, a plurality of openings around said central column;

an outer terminal having a plurality of depending contacts and fitted over said central column such that said depending contacts are press fitted into said openings and that projecting contact portions are bent outwardly to provide ground contacts; and an inner terminal having a central contact inserted into said aperture and a contact leg set on a rear face of said molding to provide a hot contact.

2. The surface-mounted high-frequency coaxial connector of claim 1, wherein said outer terminal has a cylindrical shape.

* * * * *